US005291867A

United States Patent [19]

Hummel et al.

[11] Patent Number: 5,291,867

[45] Date of Patent: Mar. 8, 1994

[54] FUEL INJECTION PUMP FOR INTERNAL COMBUSTION ENGINES

[75] Inventors: Karsten Hummel, Beilstein-Schmidhausen; Karl Rapp; Ernst Ritter, both of Stuttgart, all of Fed. Rep. of Germany

[73] Assignee: Robert Bosch GmbH, Stuttgart, Fed. Rep. of Germany

[21] Appl. No.: 60,621

[22] Filed: May 14, 1993

[30] Foreign Application Priority Data

May 30, 1992 [DE] Fed. Rep. of Germany ..... 4217940

[51] Int. Cl.[5] ..... F02D 31/00; F02N 17/00; F02B 77/00

[52] U.S. Cl. ..... 123/372; 123/179.17; 123/198 DB

[58] Field of Search ..... 123/357, 358, 359, 372, 123/385, 179.17, 198 D, 198 DB

[56] References Cited

U.S. PATENT DOCUMENTS

| | | | |
|---|---|---|---|
| 4,112,897 | 9/1978 | Hufendiek | 123/179.17 |
| 4,208,998 | 6/1980 | Hoffman et al. . | |
| 4,372,267 | 2/1983 | Adams | 123/372 |
| 5,080,063 | 1/1992 | Augustin | 123/357 |
| 5,131,358 | 7/1992 | Grieshaber | 123/198 DB |

*Primary Examiner*—E. Rollins Cross

*Assistant Examiner*—Thomas N. Moulis

*Attorney, Agent, or Firm*—Edwin E. Greigg; Ronald E. Greigg

[57] ABSTRACT

A fuel injection pump for internal combustion engines having in-line cylinder bushes, in each of which a pump piston defining a pump work chamber is guided, the piston being rotatable by a governor rod for the sake of fuel supply quantity regulation. Mounted on the pump housing is an adjusting device, in which an adjusting piston is guided axially parallel with the governor rod; the adjusting piston has a radial pin, which protrudes through a slit in the wall of the adjusting device and pump housing into an oblong slot of the governor rod, thus limiting the adjusting motion of the rod in certain operating ranges. The position of the adjusting piston determines the maximum governing travel of the governor rod in the full-load direction upon engine starting. The adjusting piston is variable via an adjustable stop acting upon one face end thereof and is also variable as a function of temperature via a temperature-dependent spring element disposed on its circumference. In addition, with its face end, the adjusting piston defines a pressure chamber, by way of which the adjusting piston can be adjusted pneumatically in the direction of a zero supply quantity; via two stops of the oblong slot, the adjusting piston moves the control rod with it in the process and in this way interrupts the fuel delivery.

7 Claims, 2 Drawing Sheets

FUEL INJECTION PUMP FOR INTERNAL COMBUSTION ENGINES

BACKGROUND OF THE INVENTION

The invention is based on a fuel injection pump for internal combustion engines as defined hereinafter. In a fuel injection pump of the type disclosed in German Patent 26 46 546, which is the same as U.S. Pat. No. 4,208,998, an adjusting device is mounted on the pump housing, an adjusting piston is longitudinally displaceably adjustable in this adjusting device, parallel to the axis of the governor rod of the fuel injection pump, by a pressure medium counter to the force of a restoring spring, and the adjusting piston has a radially protruding intermediate member that via a windowlike recess in the pump housing engages an oblong slot of the governor rod. The axial boundary edges of the oblong slot in the direction of governor rod motion, in cooperation with the intermediate member, form one stop each in the directions of the full-load and zero supply quantities, the stops corresponding to stop positions and becoming operative only when the adjusting piston has been displaced. The motion of the adjusting piston tripped by the pressure medium serves to adjust it in the direction of a zero supply quantity, and the intermediate member comes to rest on the boundary edge of the governor rod; as the adjusting motion continues, counter to the force of a drag member on the governor, the adjusting piston displaces the governor rod as far as a stop position. The known adjusting device is used in this way primarily to turn off the engine; via a support forming a stop of the adjusting piston in the event of pressure relief, the maximum supply quantity position is also adjustable via the adjusting device, especially when the engine is started. For that purpose, it is possible to embody this stop adjustably and to control this adjustment as a function of engine operating parameters, such as temperature. However, if it is intended that the known adjusting device not only perform the shutoff function but also provide an adjustable starting quantity and independently thereof a temperature-dependent starting quantity control as well, then additional components are required, and they must be mounted on the housing of the adjusting device, which means that they take up additional space.

OBJECT AND SUMMARY OF THE INVENTION

The fuel injection pump according to the invention has an advantage over the prior art that by disposing the temperature-dependent adjusting member inside the adjusting device, the space required for installing the adjusting device can be kept small, while its shutoff function and an additional option for controlling the starting quantity are preserved. To that end, and advantageously the adjusting piston is acted upon by a temperature-dependent spring element; this element is supported on a stop structurally connected to the housing, expands upon being heated, and acts upon the adjusting piston via a stop. This spring element is embodied as a memory spring, which makes reliable and economical adjustment of the starting quantity possible. It is advantageously also possible for the adjusting path of the temperature-dependent starting quantity control member, formed by the temperature-dependent spring, to be varied from outside, thereby making later adjustment of a temperature-dependent full-load stop possible as well. To provide the capability of adjusting the starting quantity of fuel even during cold starting of the engine, when the temperature-dependent starting quantity control member is not operative, a further externally actuatable adjusting screw is screwed into the housing of the adjusting device in such a way that it acts upon the face end remote from the temperature-dependent spring. The configuration of the adjusting device according to the invention, in which all the components serving the purpose of adjustment are located inside the housing, thus makes it possible for the shutoff function via a pressure medium, temperature-dependent starting quantity control, and an adjustable starting quantity stop, all to be achieved without increasing the space required for installing a known adjusting device.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
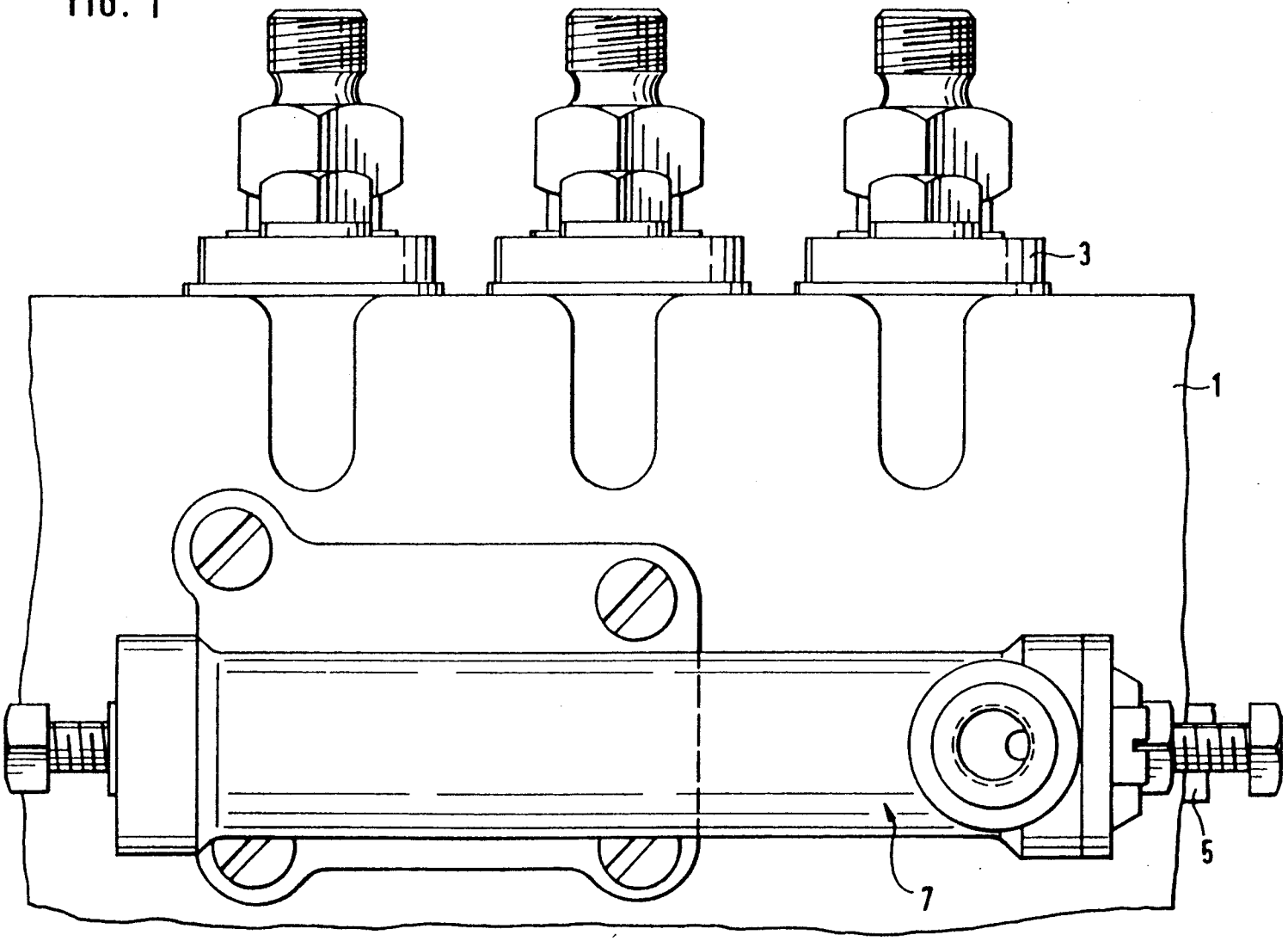
FIG. 1 shows part of a known fuel injection pump in a side view, in which the installed position of the adjusting device on the pump housing is shown.

In the fuel injection pump shown in FIG. 1, of which only its region essential to the invention is seen, a plurality of cylinder liners 3 are inserted in a line into a pump housing 1; each has a cylinder bore, not shown, in which a pump piston, again not shown, that defines a pump work chamber is moved axially by a cam drive and is rotated in a known manner, to adjust the injection or regulate the fuel supply quantity, via a governor rod 5 that is moved by a positioner via a resilient drag member of a speed-dependent governor. By way of example, this applies both to in-line pumps, having the known oblique control edge provided on the pump piston and cooperating with a relief bore, structurally connected to the housing, in the cylinder bore wall, and to injection pumps in which a slide on the pump piston is adjustable by a governor rod in order to control the injection quantity and/or the injection time, and in which at the same time the pump piston is optionally displaceable by a governor rod.

Figure 2:
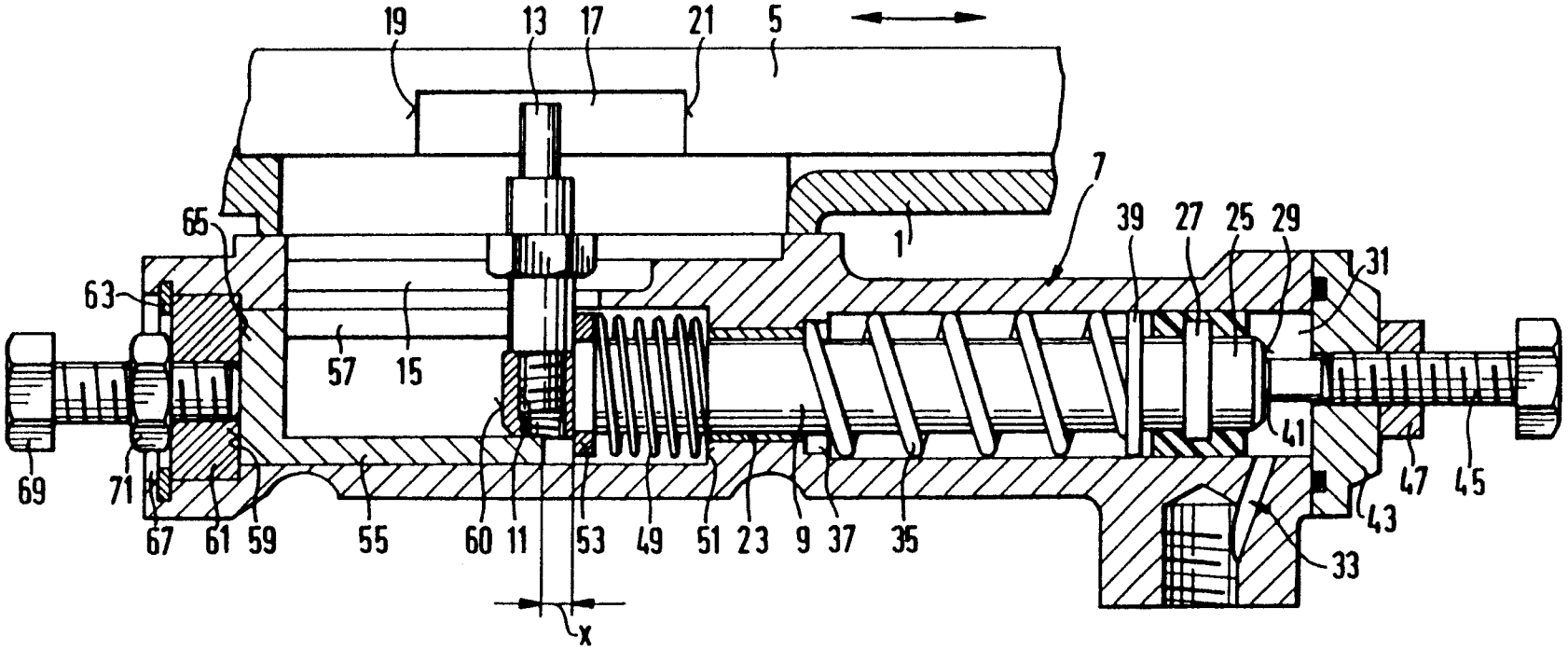
FIG. 2 is a section through the adjusting device, rotated by 90°, with part of the adjacent pump housing and the governor rod.

The pump work chamber in turn communicates via an injection line, not shown, with an injection valve discharging into a combustion chamber of the engine to be supplied, and it is supplied with fuel from a low-pressure chamber surrounding the cylinder liner 3 via control openings in the cylinder bore wall. On the pump housing 1, an adjusting device 7 is disposed parallel to the axis of the governor rod 5; as FIG. 2 shows, an adjusting piston 9 is supported in the adjusting device such that it can be displaced parallel to the axis of the governor rod 5. On one end, this adjusting piston 9 has a radial bore 11, into which a pin 13 is screwed that protrudes through an oblong-slot-like window 15 in the wall of the adjusting device 7 and of the pump housing 1 into an oblong slot 17 located in the governor rod 5 in the longitudinal direction thereof, and thus couples the governor rod to the adjusting device 7. The axial motions of the oblong slot 17 form two stops for the pin 13;

the left-hand boundary forms a first stop 19, which limits the governing path of the governor rod 5 in the direction of the full-load supply quantity, and the right-hand boundary forms a second stop 21, which limits the governing path of the governor rod 5 in the direction of the zero supply quantity.

Over its circumferential surface, the adjusting piston 9 is slideably displaceably guided in a bush 23 created inside the adjusting device 7 by a cross-sectional reduction; this bush simultaneously divides the interior of the adjusting device 7 into two regions, whose diameters are enlarged compared with the bush 23. In a first of these regions, which is located on the side remote from the pin 13, a rib 27 is disposed on the end of the adjusting piston 9 and axially guides a sealing ring 25 on the end of the adjusting piston 9. With its outer circumferential surface, the sealing ring 25 slides along the inner wall of the adjusting device 7 and thus divides the chamber defined by one face end 29, that is, the one remote from the pin 13, of the adjusting piston 9 from the chamber bordering the bush 23. The chamber defined by the face end 29 and a cap 43 axially closing the adjusting device 7 then forms a pressure work chamber 31, which can be made to communicate through a pressure medium conduit 33 with a source of pressure medium, which preferably furnishes compressed air. A restoring spring 35 in the form of a helical compression spring is disposed on the adjusting piston 9 in the chamber between the bush 23 and the sealing ring 25; this spring is supported at one end on a shoulder 37, structurally connected to the housing, of the bush 23 and on the other on an axially secured ring 39 on the adjusting piston 9; this ring may be embodied as a snap ring. This restoring spring 35 holds the adjusting piston 9 by its face end 29 remote from the pin 13 against an adjustable stop 41 when the pressure in the pressure work chamber 31 is slight; the stop 41 is formed by an adjusting screw 45, which is screwed into the cap 43 in the axial extension of the adjusting pin 9 and is secured against twisting independently by a nut 47.

In the region of the adjusting device 7 receiving the pin 13, a temperature-dependent spring element 49 in the form of a helical compression spring is disposed on the adjusting piston 9; it is supported on one end on a housing shoulder 51 formed by the bush 23 and on the other on a guide ring 53, which in turn, on the side remote from the spring element 49, rests on the pin 13 and is axially secured on the adjusting piston 9. The maximum spring travel by which the temperature-dependent spring element 49 expands if heat is supplied, and hence the temperature-dependent adjusting travel of the adjusting piston 9, are both limited by a slit sleeve 55 guided axially in the adjusting device 7, because the spring element 49 causes the guide ring 53 to come to rest on one face end of the slit sleeve. The slit 57 of the sleeve 55 is embodied such that the radial pin 13 disposed on one end of the adjusting piston 9 is not hindered by the sleeve 55 during an axial adjusting motion of the adjusting pin 9. The face end 59 of the sleeve 55 remote from the pin 13 is closed and rests on a further cap 61, which closes the region of the adjusting device 7 that receives the temperature-dependent spring element 49. This cap 61, which is embodied as a disk and is axially held by a securing ring 63 on a stop 65 in a housing bore 67, has a central bore into which an adjusting screw 69 is screwed in such a way that when it emerges from the cap 61 it acts upon the end face 59 of the sleeve 55. This makes it possible to adjust the temperature-dependent adjusting path of the adjusting piston 9 from outside even after the adjusting device 7 has been installed; once again, a securing nut 71 on the adjusting screw 69 prevents the screw from twisting independently.

The adjusting device 7 of the fuel injection pump according to the invention functions as follows:

When the cold engine is started, the adjusting device 7 is in its outset position; that is, the adjusting piston is held with its face end 29 on the stop 41 by the restoring spring 35. The governor rod 5 is in the fuel supply quantity adjusting position, in the direction of full load, which is equivalent to the cold-starting quantity; its first stop 19 of the oblong slot 17 rests on the pin 13. The position of the adjusting piston 9 of the adjusting device 7 thus determines the maximum fuel supply quantity upon cold starting of the engine, and this position of the adjusting piston 9 is adjustable by the adjustable stop 41. Once the engine has started, the governor rod 5 is displaced in the direction of a lesser fuel supply quantity by the speed-dependent governor, so that the stop 19 lifts from the pin 13, and the governor rod 5 can be actuated independently of the adjusting device 7.

If the engine is to be shut off, then the pressure medium, preferably compressed air, is supplied to the pressure chamber 31 from a reserve tank, not shown, via the pressure medium conduit. The pressure in the pressure chamber 31 then increases, exceeds the force of the restoring spring 35, and moves the adjusting piston 9 until its end face 60 contacts the end face 59 of the sleeve 55. The radial pin 13 on the adjusting piston 9 then again comes into contact with the first stop 19 on the oblong slot 17 of the governor rod 5, and as the motion of the adjusting piston 9 continues, moves the governor rod in the direction of the zero supply quantity, counter to the force of the resilient drag member of the governor, so that the engine's fuel feed pump no longer delivers any fuel, and as a result the engine is shut off. In this adjusting process of the adjusting piston 9, the guide ring 53 can slide freely on the adjusting piston 9. If an engine is started again while it is still at operating temperature, then the adjusting piston 9 of the adjusting device 7 is displaced counter to the force of the restoring spring 35 by the spring element 49, which is now lengthened in accordance with the temperature resulting from the heat radiated by the engine, far enough in the direction of the sleeve 55 so that the guide ring 53 rests on the end of the sleeve 55. The pin 13 is thus also displaced in the direction of a lesser fuel supply quantity, and thus in the adjusting motion in the direction of the starting quantity, the governor rod 5 comes into contact with the pin 13 after even a shorter governing travel than in the case of cold starting, so that less fuel is now delivered than in cold starting.

Advantageously, the spring element 49 is embodied as a so-called memory spring and is made of a material that has a shape memory capability, such that it always assumes the same shape at a predetermined temperature, regardless of any change in shape that might have occurred in the meantime. This property is employed here for the sake of temperature-dependent adjustment of the adjusting piston position, in such a way that in a warm engine the spring acts as a strong spring, while in a cold engine, it can be deformed by the restoring spring 35.

The adjusting device 7 according to the invention of the fuel injection pump can also be mounted on an adjusting lever on the governor, or on the end of the governor rod, and accordingly makes it possible to shut off the engine pneumatically, to regulate the cold-starting fuel quantity, and to regulate the starting quantity as a function of temperature, all in the same housing, so that no additional space has to be occupied; the starting quantity stops can also be adjusted from outside at any time.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A fuel injection pump for internal combustion engines, comprising in-line pump pistons guided in cylinder liners (3) and each defining one pump work chamber; a governor rod (5) is supported longitudinally of the fuel injection pump in a pump housing (1) and is displaceable by a positioner in order to adjust a fuel injection quantity by the pump pistons and is joined to the positioner via a resiliently yielding drag member; and an adjusting device (7), said adjusting device including an adjusting piston (9) adjustable away from a stop (41) by a pressure medium counter to a force of a restoring spring (35), the adjusting piston acting upon the governor rod via an intermediate member (13) positioned between first and second stops (19, 21), said stops being located in succession in the direction of motion and disposed on at least one part that is moved with the governor rod upon its fuel injection quantity adjusting motion, said stops being arranged for limiting a governor rod travel that is predetermined by the spacing of said stops, the adjusting piston (9) of the adjusting device (7) is displaceable as a function of the engine operating temperature by a temperature-dependent spring element (49), which spring element is disposed on a circumference of the adjusting piston and is supported at one end on a further third stop (51) that is structurally connected to the housing and acts counter to the restoring spring (35), the displacement of the adjusting piston (9) being such that the possible adjusting travel of the governor rod (5) is variable in the direction of a full-load supply quantity by contact of one of said first and second stops (19, 21) with the intermediate member (13).

2. A fuel injection pump as defined by claim 1, in which the temperature-dependent spring element (49) is supported via a sleeve (55) that is slidingly displaceable on the adjusting piston (9) and that by means of the spring element comes to contact a fourth stop (53) on the adjusting piston and the sleeve can be made to contact an adjustable fifth stop (65) on the housing of the adjusting device (7) by the spring element, the displaceable sleeve (55) is embodied as a stop sleeve, having a longitudinal slit (57) through which the intermediate member (13) radially protrudes from the adjusting piston (9) and is guided in the slit 57.

3. A fuel injection pump as defined by claim 2, in which the face end (29) of the adjusting piston (9) remote from the stop sleeve (55) and the temperature-dependent spring element (49) can be made by the restoring spring (35) to contact an externally adjustable adjusting screw (45) that is screwed into the housing on its face end, by means of the adjusting screw, the maximum adjusting travel of the governor rod (5) is fixed in the direction of the full-load supply quantity upon starting of a cold engine.

4. A fuel injection pump as defined by claim 3, in which the temperature-dependent spring element (49) is designed such that when the engine is cold, the spring element exerts no biasing force, or a substantially lesser biasing force than that of the restoring spring (35), upon the adjusting piston (9), and in order to establish a zero supply quantity position of the governor rod (5), the adjusting piston (9) is acted upon on one end by a pressure medium.

5. A fuel injection pump as defined by claim 1, in which the pressure medium acting upon the adjusting piston (9) acts on a face end (29) thereof remote from the temperature-dependent spring element (49).

6. A fuel injection pump as defined by claim 1, in which the restoring spring (35) acting counter to the pressure medium or to the temperature-dependent spring element (49) is embodied as a compression spring, which is supported on a further stop (37) structurally connected to the housing and encompasses the adjusting piston (9), and acts upon the adjusting piston via a ring (39) disposed on the circumference of the adjusting piston.

7. A fuel injection pump as defined by claim 1, in which the temperature-dependent spring element (49) is embodied as a memory-type compression spring.

* * * * *